US010478701B2

(12) United States Patent
Rimback

(10) Patent No.: US 10,478,701 B2
(45) Date of Patent: Nov. 19, 2019

(54) GOLF BALL STOPPING DEVICE FOR SIMULATING A PUTTING GREEN HOLE

(71) Applicant: Peter D. Rimback, Cleveland, OH (US)

(72) Inventor: Peter D. Rimback, Cleveland, OH (US)

( * ) Notice: Subject to any disclaimer, the term of this patent is extended or adjusted under 35 U.S.C. 154(b) by 0 days.

(21) Appl. No.: 15/857,999

(22) Filed: Dec. 29, 2017

(65) Prior Publication Data

US 2018/0185732 A1 Jul. 5, 2018

Related U.S. Application Data

(60) Provisional application No. 62/498,652, filed on Jan. 4, 2017.

(51) Int. Cl.

| | |
|---|---|
| ***A63B 71/00*** | (2006.01) |
| ***A63B 69/36*** | (2006.01) |
| ***A63B 63/00*** | (2006.01) |
| ***A63B 57/30*** | (2015.01) |

(52) U.S. Cl.
CPC ..... *A63B 69/3676* (2013.01); *A63B 57/30* (2015.10); *A63B 63/00* (2013.01); *A63B 69/3697* (2013.01)

(58) Field of Classification Search
CPC ..... A63B 57/40; A63B 57/357
USPC ..... 473/186–189
See application file for complete search history.

(56) References Cited

U.S. PATENT DOCUMENTS

| | | | | |
|---|---|---|---|---|
| 3,458,202 | A * | 7/1969 | McNamara | A63B 69/3676 473/188 |
| 5,257,808 | A * | 11/1993 | Mueller | A63B 69/3623 473/174 |
| 8,870,672 | B2 | 10/2014 | Downing | |
| 2004/0185953 | A1* | 9/2004 | Carilli | A63B 63/06 473/174 |

OTHER PUBLICATIONS

Putt-A-Round Putting Aid—Perfect Custom Golf Gift, Tournament Prize, https://puttaroundgolf.com, published Oct. 15, 2016.
Dead Zero, "Dead Zero Pulling Disk", www.deadzeroputting.com, published May 8, 2013.

(Continued)

*Primary Examiner* — Raeann Gorden
(74) *Attorney, Agent, or Firm* — Emerson, Thompson & Bennett, LLC; Roger D. Emerson

(57) ABSTRACT

The present disclosure is directed to a novel golf ball stopping device. The golf ball stopping device includes an upper plate, set at a height so it slows or stops a golf ball which rolls under the plate. The underside of the plate includes a material and structure that provides resistance to the golf ball as it contacts the device. The plate may be supported by a center post, so the golf ball can be aimed at the device from any direction and perform the same function. The center post fits together with a base, and is adjustable to the base so the plate can be positioned at a desired height. The base may be weighted to achieve the optimal friction on the golf ball and to provide stability to the device. The base may include a plurality of downward facing protrusions in order to grip the surface on which it is set and keep the device from spinning when a golf ball rolls under the outer edge of the device.

3 Claims, 6 Drawing Sheets

(56) References Cited

OTHER PUBLICATIONS

Putters.com, "The Putting Lane—Azimuth Golf System Training Aid", http://www.putters.com/The-Putting-Lane--Azimuth-Golf-System-Training-Aid_p_120.html, published 2010.
CS2 Target Putting Cup, "CS2 Putting Cup", https://www.youtube.com/watch?v=cif8UVPzFsQ, published Feb. 4, 2015.

* cited by examiner

GOLF BALL STOPPING DEVICE FOR SIMULATING A PUTTING GREEN HOLE

TECHNICAL FIELD

The present disclosure relates to golf putting accessories, and more particularly to a device to stop a rolling golf ball and thereby simulate a hole on a putting green and the like.

BACKGROUND

Putting accessories have been a popular tool for golfers to practice putting in the convenience of their home and/or in the off-season. It is desirable to vary the putting distance and surface contour to realistically simulate the challenges faced on a green at a golf course and thus improve the putting skill of a golfer. There are many types of putting practice accessories which vary in realism, cost, and ease of use, and user enjoyment.

Putting practice devices fall under two the main categories of single-direction and multi-direction.

Single-direction devices consist of one of various types of target for the ball, some of which include a return mechanism and a carpet. Sometimes the target end is raised up so the ball can fall into a hole, then follow a track to return to the starting place. This is unrealistic to putting on the green of a golf course because the area around a hole on a green is not raised a few inches from the remainder of the green. On other units the entire putting area is raised, so the putting surface is flat and the ball falls into a hole. The disadvantage to this is that it makes the unit very bulky. Putting in a straight line can quickly become rote and thus bore the user. It does not promote the variety required to imitate putting on a golf course.

Multi-direction putting devices are also referred to as artificial putting greens. Some have actual holes and can be used indoor or outdoor. If they are used outdoors, extensive work, materials, and money are required to provide water drainage, and to smooth and prepare an area. If these artificial greens are used indoors, a raised platform must be built. Additional time, cost and materials are required in order to include a contoured surface to the platform. While artificial greens are the most similar to a golf course green, the cost and effort to establish them are a disadvantage.

Another category of putting hole simulators is a stand-alone, ball stopping device. The disclosed invention falls within this category. Most of these devices are ring-shaped and rely on trapping the ball within the ring. However if the ball strikes the ring on the far left or far right edge, it is likely to bounce off and not enter the ring. This has the opposite effect of a hole in a putting green, and is therefore not realistic.

One patent pending device on the market which is a solid metal puck, which is used as a putting target. The device is approximately half the diameter of a putting hole. It does not stop the ball, therefore it is not as accurate in depicting whether the ball would have fallen into a putting green hole.

Presently, there is no solution which is easy to set up, versatile, accurately simulates a putting hole, and can be used as a game.

SUMMARY

The following is intended to be a brief summary of the invention and is not intended to limit the scope of the invention. The present invention comprises a novel golf ball stopping device generally consisting of an upper plate, set at a height so it slows or stops a golf ball which rolls under the plate. The underside of the plate may consist of a material and structure that provides resistance to the golf ball. The plate may be supported by a center post, so the golf ball can be aimed at the invention from any direction and perform the same function. The center post fits together with a base, and is adjustable to the base so the plate can be positioned to a desired height. The base may be weighted to achieve the optimal friction on the golf ball and to provide stability to the invention. The base may consist of downward facing protrusions in order to grip the surface on which it is set and keep the invention from spinning when a golf ball rolls under the invention near the outer edge.

Provided is a putting practice aid for stopping a rolling golf ball by trapping the ball from above. According to certain aspects of the present teaching, the putting practice aid includes: an upper plate having approximate size of a putting hole; flexible bristles on the underside of the plate which brush against the top of a golf ball if it rolls under the plate; a post receiving unit extending downward from the center of the plate; a post having a top portion which connects to the post receiving unit and a bottom portion which connects to a base, wherein the base is connected to the bottom portion of the post, wherein the base can be set at different heights along the post, in order to allow the plate to be positioned at various heights with respect to a surface; a weight inside the base in order to prevent unwanted tipping and to provide increased friction to the golf ball; and downward pointing teeth along the outer edge of the bottom portion of the base, so as to assist the base to grip a carpet or green-like surface.

According to further aspects of the present teaching, the putting practice aid is placed on a ground surface, a carpet or an artificial green-like surface to simulate multiple putting green holes and create a putting practice area and course for putting games.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION

Figure 1:
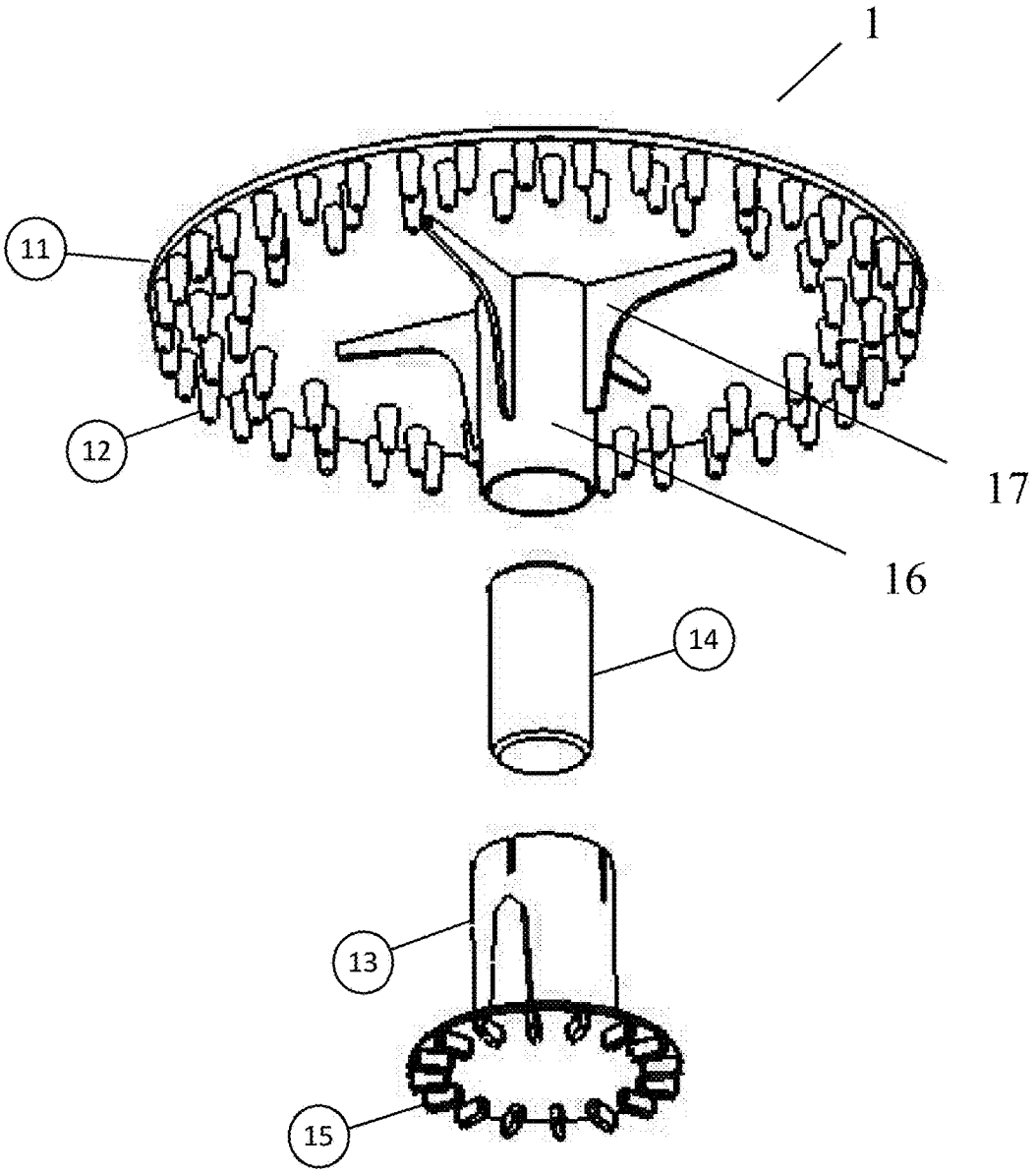
FIG. 1 shows an exploded perspective view of a first working example.

The golf ball stopping device will now be described by referencing the appended figures which represent exemplary embodiments. FIG. 1 depicts an exploded perspective view of the component parts of a device for stopping a rolling golf ball according to certain embodiments of the present disclosure. The device shown in FIG. 1 stops a rolling golf ball by contacting the top of the ball.

The component parts of the golf ball stopping device (1) shown within FIG. 1 will now be described in greater detail.

As shown within FIG. 1, the top of the golf ball stopping device includes a plate (11) having a top side and bottom side. This plate may also be referred to as a stopping plate (11). The stopping plate (11) provides a target for the player to aim at as he or she hits a golf ball towards the device. In certain embodiments, the stopping plate (11) is designed to approximate the size of a putting green hole. The stopping plate (11) stops a golf ball which passes under the bottom side of the plate (11).

The stopping plate (11) may have a variety of surface features (12) such as textures, protrusions or any type of materials on the surface of the bottom side of the plate (11) to assist in stopping the ball. In the embodiment shown within FIG. 1, the bottom side of the stopping plate includes soft flexible bristles (12) to slow and stop the ball. However, it is understood that the surface feature on the bottom side of the plate (11) may be formed from any type of material and may be any shape and size within the sound judgement of a person of ordinary skill in the art for stopping the ball. According to certain aspects of the present teaching, the surface features or bristles (12) may be positioned towards the outer edge on the bottom side of the plate (11) as shown within FIG. 1. In such embodiments, the interior portion of the bottom side of the plate may not include any surface features or bristles (12) or may include fewer surface features or bristles (12) than on the outer edge on the bottom side of the plate (11). This allows surface features or bristles (12) to trap the ball as it passes under the device and allows the ball to fit snuggly between the surface features or bristles (12) and the surface on which the golf ball stopping device is sitting on or the surface on which the ball rolls or rests on.

The stopping plate (11) is elevated from the putting surface by a post (14) which is connected to a post receiving unit (16) on the bottom side of the stopping plate. As shown within FIGS. 1 and 2, the post receiving unit (16) on the stopping plate (11) includes a reinforcement brackets (17) to secure the post receiving unit (16) to the stopping plate (11). In certain embodiments, the post (14) has a first end which fits within an opening within the post receiving unit (16) on the stopping plate (11) and a second end which fits an opening within a base (13) of the golf ball stopping device. However, it is understood that the post receiving unit (16) on the stopping plate (11) and the base (13) of the golf ball stopping device may be designed to fit within the respective openings within the post. According to certain aspects of the present teaching, the post is adjustable allowing the stopping plate (11) to be positioned at various heights from the ground surface. This allows golf ball stopping device to accommodate different putting surfaces, putting surface materials or carpets of varying thicknesses. Adjustment of the height of the golf ball stopping device may be accomplished by positioning the stopping plate (11) and the base (13) at various points along the length of the post (14). According to certain embodiments, the post (14) may be extended or retracted in a telescoping manner to adjust the length of the post (14). The height of the golf ball stopping device may also be adjusted by swapping out the post (14) with a post (14) having a different length.

As mentioned above, the golf ball stopping device includes a base (13) which supports the post at various heights. The base has a lower flange that provides stability to the unit as it is positioned on the ground surface. A weight (not shown) may be positioned inside the base (13) and post (14) to provide a downward force or pressure to assist in stopping the ball. The weight also serves to help keep the unit from falling over too easily. In certain aspects of the present teaching, it is desirable for the golf ball stopping device to fall over when the ball is rolling so fast that it would roll over a hole on a standard putting green.

The bottom surface of the lower flange of the base (13) includes a plurality of feet (15) which grip the putting green surface and assist in keeping the unit from spinning, especially if the ball tangentially contacts the bristles on the far left or the far right portions of the plate and does not directly hit the golf ball contact device.

Figure 2:
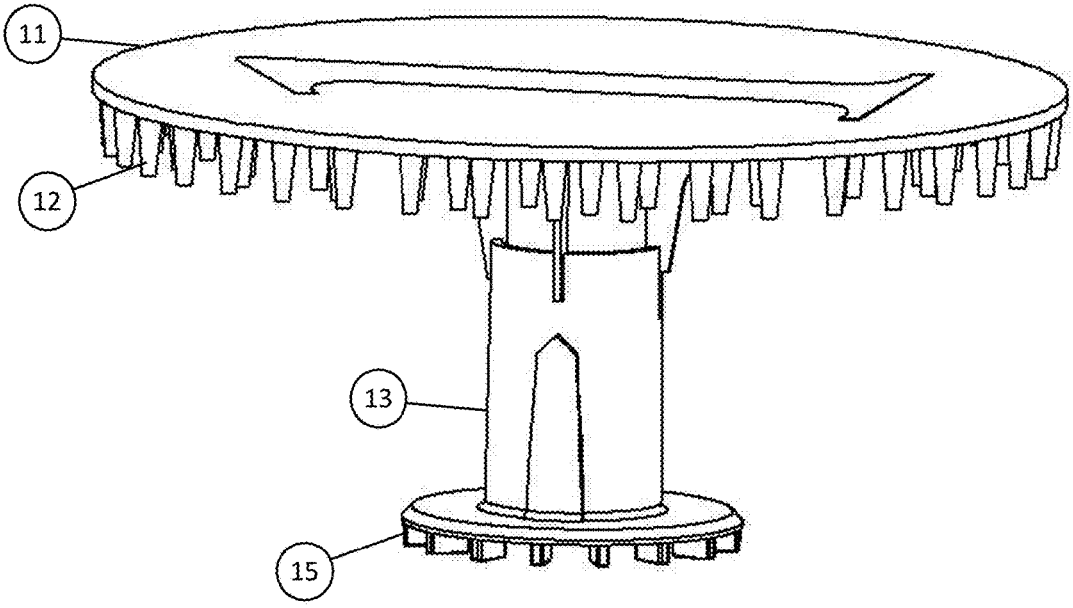
FIG. 2 shows a perspective view of the assembled working example of FIG. 1.
Figure 3:
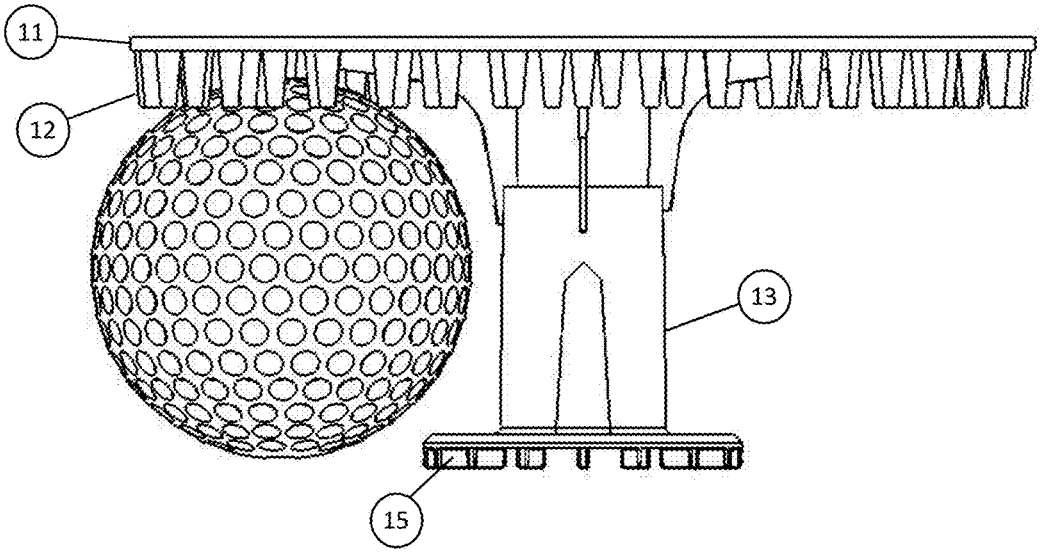
FIG. 3 shows a side view of the assembled working example of FIG. 1 with a golf ball under the plate.
Figure 4:
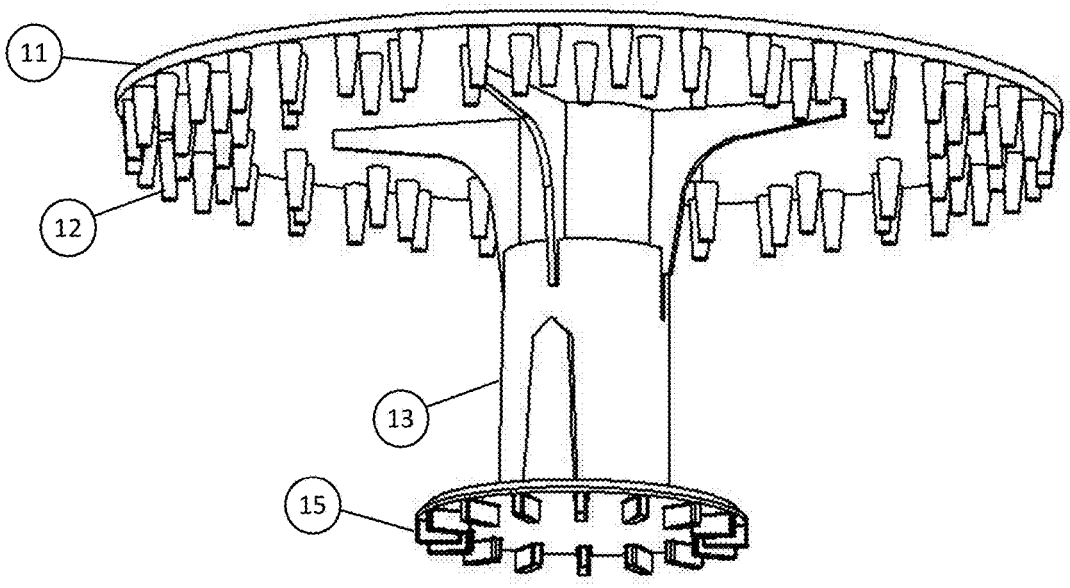
FIG. 4 shows a perspective lower view of the assembled working example of FIG. 1.

FIGS. 2 and 4 show an assembled perspective view of the golf ball stopping device shown within FIG. 1. FIG. 3 shows a side view of the golf ball stopping device with a golf ball trapped under the stopping plate (11).

Figure 5:
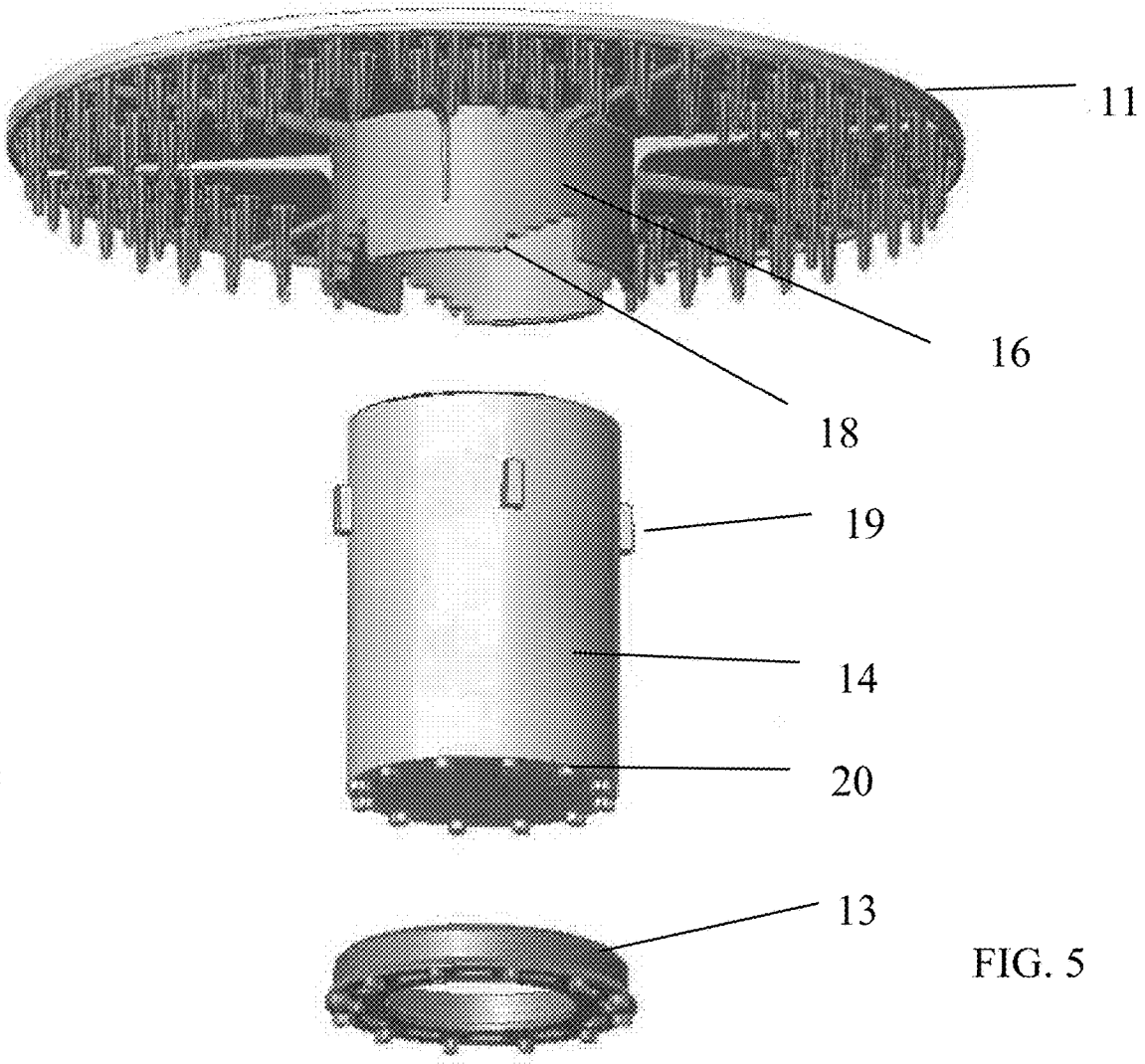
FIG. 5 shows an exploded perspective view of a second working example.
Figure 6:
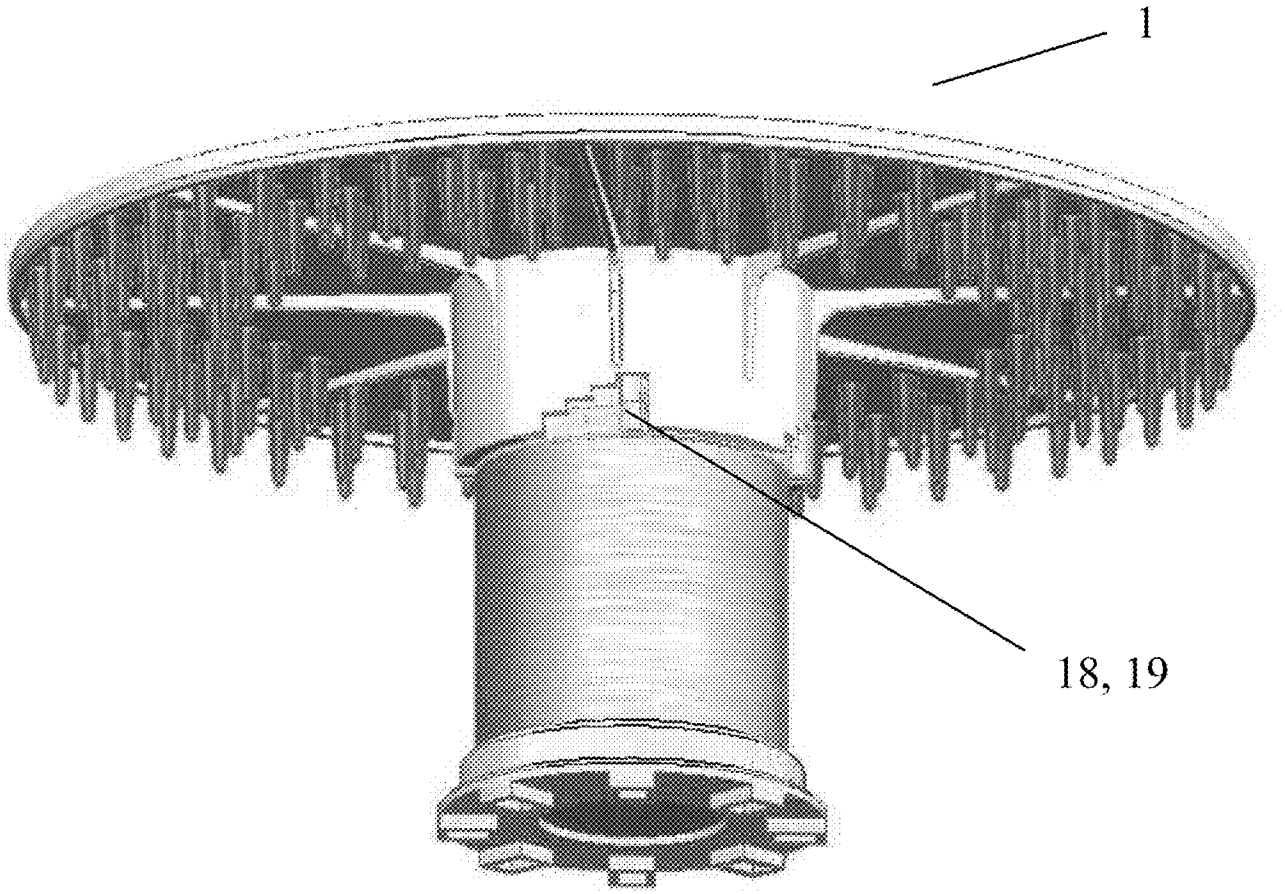
FIG. 6 shows a perspective lower view of the assembled working example of FIG. 5.

FIGS. 5 and 6 illustrate an alternate embodiment of the golf ball stopping device (1). In this embodiment, the post receiving unit (16) on the bottom side of the stopping plate (11) includes a step cutout (18) for receiving a first tab (19) positioned on the outer surface at the top end of the post (14). This allows the stopping plate (11) to be locked into position with respect to the top end of the post (14). The bottom surface of the post (14) includes a second tab (20) which is designed to fit within a tab receiving end (not shown) on the top surface of the base (13). This allows the bottom end of the post (14) to be locked into position with respect to the top end of the base (13). It is understood that the golf ball stopping device may include any number of step cutouts (18), first tabs (19) and second tabs (20) as deemed suitable for use by a person of ordinary skill in the art.

What is claimed is:

1. A device for stopping a ball, comprising:
an upper plate;
a series of bristles on the underside of the plate;
a post receiving unit affixed to the plate;
at least one bracket on the underside of the plate to secure the post receiving unit to the plate;
a base, wherein the base is positioned about a surface, and;
a post having a top portion which connects to the post receiving unit and a bottom portion which connects to the base, wherein the height of the plate relative to the base is adjustable;
wherein the plate may be set to a height relative to the surface such that a ball rolling underneath the plate will contact the bristles and be stopped.

2. A device for stopping a ball, comprising:
an upper plate;
a series of bristles on the underside of the plate;
a post receiving unit affixed to the plate;
a base, wherein the base is positioned about a surface;
at least one cutout on the post receiving unit and at least one corresponding tab on the top of the post, wherein the at least one cutout is capable of receiving the at least one corresponding tab so as to adjust the height of the plate relative to the base, and;
a post having a top portion which connects to the post receiving unit and a bottom portion which connects to the base, wherein the height of the plate relative to the base is adjustable;
wherein the plate may be set to a height relative to the surface such that a ball rolling underneath the plate will contact the bristles and be stopped.

3. A device for stopping a ball, comprising:
an upper plate;
a series of bristles on the underside of the plate;
a post receiving unit affixed to the plate;
a base, wherein the base is positioned about a surface;
a series of step cutouts on the post receiving unit and a series of corresponding tabs on the top of the post, wherein the series of step cutouts are capable of receiving a corresponding tab at a desired location to adjust the height of the plate relative to the base, and;

a post having a top portion which connects to the post receiving unit and a bottom portion which connects to the base, wherein the height of the plate relative to the base is adjustable;

wherein the plate may be set to a height relative to the surface such that a ball rolling underneath the plate will contact the bristles and be stopped.

* * * * *